US005219409A

United States Patent [19]

Campbell et al.

[11] Patent Number: 5,219,409

[45] Date of Patent: Jun. 15, 1993

[54] VACUUM DIE CASTING PROCESS

[75] Inventors: Dave L. Campbell; George R. Clark, both of Waukegan; Frank W. Kenik, Wadsworth, all of Ill.; Russell J. VanRens, Milwaukee, Wis.

[73] Assignee: Outboard Marine Corporation, Waukegan, Ill.

[21] Appl. No.: 874,648

[22] Filed: Apr. 27, 1992

[51] Int. Cl.[5] ..... B22D 17/14; B22D 17/32

[52] U.S. Cl. ..... 164/457; 164/4.1; 164/61; 164/65; 164/113

[58] Field of Search ..... 164/457, 4.1, 61, 63, 164/65, 113, 154, 155, 305, 253, 254, 312

[56] References Cited

U.S. PATENT DOCUMENTS

| | | | |
|---|---|---|---|
| 1,717,608 | 6/1929 | Kadow . | |
| 2,515,231 | 7/1950 | Kalina . | |
| 2,904,861 | 9/1959 | Morgenstern . | |
| 3,268,960 | 8/1966 | Morton . | |
| 3,283,372 | 11/1966 | Moorman et al. . | |
| 3,310,850 | 3/1967 | Armbruster . | |
| 4,787,436 | 11/1988 | Ozeki et al. | 164/305 |
| 4,836,272 | 6/1989 | Priem | 164/457 |
| 4,871,010 | 10/1989 | Dannoura | 164/312 X |
| 5,086,824 | 2/1992 | Tsuda et al. | 164/4.1 |
| 5,101,882 | 4/1992 | Freeman | 164/457 |

FOREIGN PATENT DOCUMENTS

| | | | |
|---|---|---|---|
| 59-85347 | 5/1984 | Japan | 164/305 |
| 59-209468 | 11/1984 | Japan | 164/457 |
| 61-23561 | 2/1986 | Japan | 164/457 |
| 63-72462 | 4/1988 | Japan | 164/61 |
| 64-27757 | 1/1989 | Japan | 164/305 |

*Primary Examiner*—J. Reed Batten, Jr.
*Attorney, Agent, or Firm*—Welsh & Katz

[57] ABSTRACT

The process calls for testing and monitoring the pressure levels in different parts of the die casting apparatus during a casting operation, including the die cavity itself and in positive and vacuum pressure lines. The process also includes process steps which cools a vacuum valve adjacent the die cavity and cleans the valve and lines during a casting operation. The process calls for aborting a casting operation at various time during the operation if certain measured parameters are not acceptable.

30 Claims, 3 Drawing Sheets

VACUUM DIE CASTING PROCESS

The present invention generally relates to the art of die casting and more particularly relates to a vacuum die casting process.

In a die casting process in which castings are successively made, molten metal is typically loaded into a shot sleeve apparatus which has a plunger mechanism that pushes the metal into the cavity of the die mold which has the desired shape of the object that is being cast.

It is generally known that metal die casting operations produce improved quality castings if the die cavity in which the casting is formed is evacuated of air prior to injection of the casting material into the cavity. It has also been found that fewer imperfections, in terms of surface spalling, the presence of bubbles and the like, occur if the metal is injected into the die cavity solely as a result of the movement of the plunger through the sleeve, and that no premature flow of the metal from the channel into the die cavity occurs from any other influence, such as by the vacuum force in the cavity pulling the metal into the cavity. If the plunger is effectively sealed so that no air can pass from behind it, then the vacuum in the die cavity will not be effective to pull casting material from the channel into the die before the plunger actually pushes it into the die cavity.

The die cavity is evacuated by applying a vacuum to the cavity, and this is generally done by opening a valve that communicates the die cavity with a source of vacuum. Before the metal reaches the cavity, it must first travel through a runner or channel that extends from the shot sleeve apparatus to the die cavity. It is preferred that the shot sleeve apparatus move at a slower rate while the metal is being pushed through the channel, but when it is injected into the cavity itself, it is done at a relatively fast rate. The vacuum valve is generally opened just before placing a shot of molten metal into the cavity and is then closed at some time during the injection of the metal into the cavity itself.

It is highly desirable that successive casting operations be carried out smoothly and efficiently, with a minimum of downtime. It is common for many prior art apparatus to experience malfunctions that result in the casting apparatus being disassembled to remove hardened casting material from internal surfaces and lines, which is often very time consuming and expensive.

Accordingly, it is a primary object of the present invention to provide an improved process for vacuum die casting that helps prevent malfunctions from occurring that would lead to such expensive disassembly and removal of casting material.

Another object of the present invention is to provide such an improved process that is controlled by a processing means which receives information relating to the status of important parameters of the process, and which aborts a casting operation if important parameters are not met.

A related object of the present invention is to provide such an improved process that can abort a casting operation at any one of several steps during the operation, with the consequences of the aborting being less consequential the earlier in the process such aborting takes place.

Yet another object of the present invention lies in the provision of lengthening the mean time between failures of a die casting apparatus because of the preventative aspects of the process.

A more detailed object of the present invention is to provide an improved process that tests and monitors the pressure levels in various parts of the apparatus, including the die cavity itself and in the positive and vacuum pressure lines. The process includes steps for cooling the vacuum valve and cleaning the same valve as well as various lines during a casting operation, and has the capability of aborting the operation if certain measured parameters are not acceptable.

Other objects and advantages will become apparent upon reading the following detailed description, while referring to the attached drawings, in which:

FIG. 1 is a schematic block diagram of the apparatus that can be used to practice the process of the present invention;

FIGS. 2 and 3 together comprise, a flow chart of the process of the present invention, which is controlled by a processing means; and, FIG. 4 is a side elevation, partially in section, of a die casting apparatus in which the process of the present invention can be practiced.

DETAILED DESCRIPTION

Broadly stated, the present invention is directed to an improved process for performing a die casting operation which is successively carried out to manufacture castings. The process is adapted for use with a die casting apparatus which utilizes vacuum to evacuate the die cavity prior to injection of the casting material into the cavity. While the process is well suited for metal castings, it is also adapted for making castings of other materials. The process is also particularly well suited for use with apparatus that is disclosed in patent application entitled SEALED SHOT SLEEVE APPARATUS FOR VACUUM DIE CASTING, Ser. No. 874,740which discloses a shot sleeve apparatus that is effective to prevent premature injection of casting material into the die cavity itself as a result of the vacuum pulling material from the channel or runner into the cavity before the plunger mechanism actually injects the material therein. The process is also particularly well suited for use with an apparatus disclosed in patent application entitled VACUUM VALVE FOR DIE CASTING, Ser. No. 874,629 which describes a vacuum valve of the type generally shown in FIG. 4 herein, which efficiently communicates vacuum to the die cavity and which is designed to facilitate maintenance work to clear the valve in the event of a malfunction. The superior operation of the vacuum valve is achieved by the apparatus disclosed in patent application entitled DOUBLE SOLENOID VALVE ACTUATOR, Ser. No. 874,755 and the necessary and desirable vacuum levels are accomplished using the teachings of patent application entitled VACUUM VALVE DESIGN FOR DIE CASTING, Ser. No. 874,368

While the improved process of the present invention is particularly well suited for being carried out with the apparatus disclosed in the apparatus of the aforementioned patent applications, it can be used with other apparatus that have similar and analogous components, such as a vacuum valve that is near the die cavity, sources of vacuum and positive air pressure, with associated valves adjacent the sources and a plunger means for injecting a shot of molten material into the die cavity.

Figure 1:
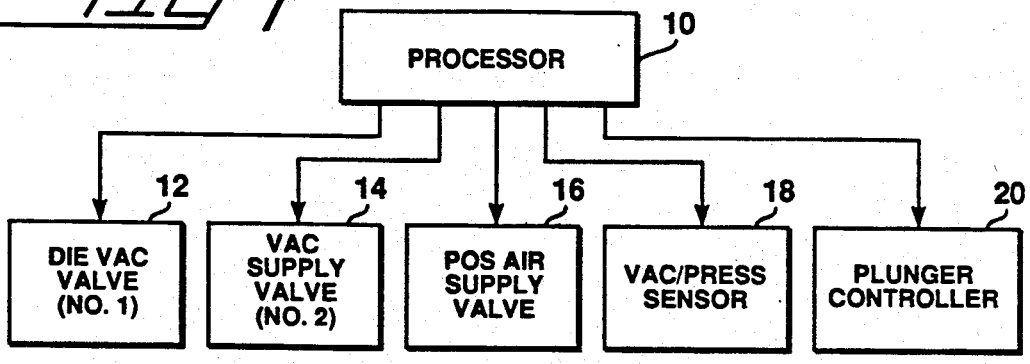
Figure 4:
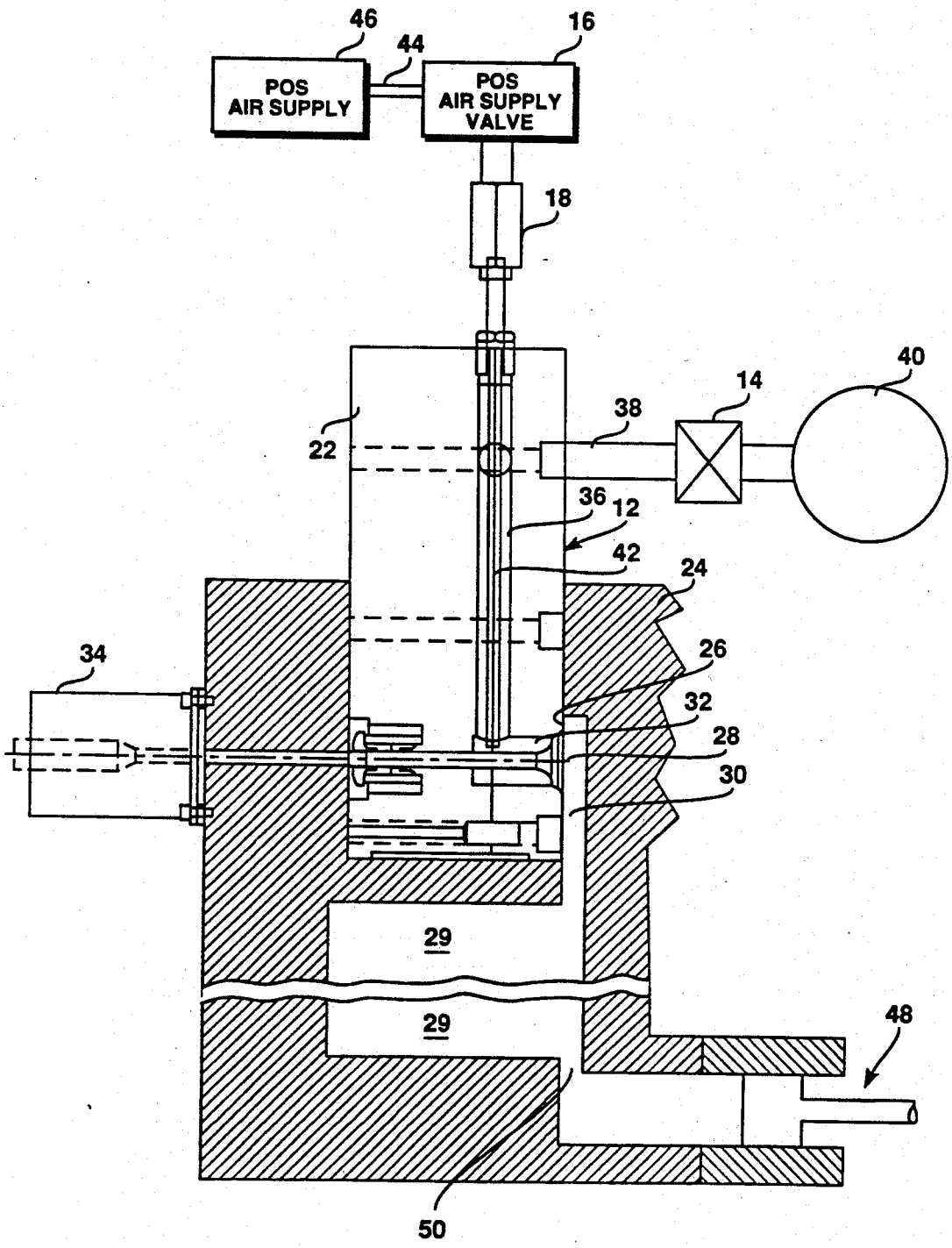

Turning now to the drawings, and particularly FIG. 1, the process embodying the present invention can be carried out using apparatus as shown, which includes a processing means 10 which is electrically connected to a die vacuum valve, indicated generally at 12 in FIG. 1 and in FIG. 4, and which is also referred to herein as the first valve. The processor 10 is also connected to a vacuum supply valve 14, which is also referred to herein as the second valve. The processor 10 is similarly connected to a positive air supply valve 16 and processor receives signals from a vacuum/pressure sensor 18. The processor is also connected to a controller 20 for the plunger mechanism and it sends and receives signals relating to the functioning of the plunger controller during the process.

Turning now to FIG. 4, the components that have been identified in FIG. 1 are also shown in FIG. 4, in addition to other structural components of the die casting apparatus in which the process of the present invention can be performed. The vacuum valve 12 has a valve body 22 that is mounted in a die 24 and the valve 12 has a valve seat 26 in which a valve member 28 seats and moves to the right to open the valve. The valve member 28 effectively isolates a die cavity 29 and a channel 30 from an inside valve chamber 32 of the valve 12. The valve member 28 is opened and closed by operation of a double solenoid arrangement 34 that is comprehensively described in the aforementioned application Ser. No. 874,755. The valve chamber 32 has a port 36 that extends to and is in communication with a vacuum line 38 that extends to the vacuum supply valve 14 which is in communication with a vacuum pump 40 that provides the source of vacuum to the apparatus. Inside the port 36 is a tube 42 that extends to the vacuum/pressure sensor 18 that is a transducer and generates electrical signals that are representative of the pressure that is measured in the tube 42. The tube 42 is also in communication with the positive air supply valve 16 which is in communication through line 44 to a source of positive air pressure 46. When the valve 16 is opened, positive pressure is injected through the tube 42 into the chamber 32 as is desired. Similarly, by virtue of the tube 42, the vacuum transducer 18 effectively measures the pressure in the chamber 32 and when the valve member 28 is moved to the right from the position shown in FIG. 4, it will measure the pressure level in the runner 30 and in the die cavity 29 itself.

When molten metal or other casting material is to be injected into the die cavity, the plunger controller 20 (FIG. 1) causes the plunger mechanism, indicated generally at 48, to be activated and it preferably moves the molten metal that has been loaded into the shot sleeve apparatus that has been comprehensively described and illustrated in the aforementioned application Ser. No. 874,740 which is specifically incorporated by reference herein, and the plunger moves at a relatively slow rate that is within the range of approximately 10 to approximately 40 inches per second, and preferably approximately 15 inches per second to force the molten metal into a runner 50 until the molten metal reaches just short of the cavity itself, during which case the plunger controller 20 increases the speed of the plunger, which is preferably hydraulically driven, so that it moves at a rate of approximately 75 to 80 inches per second and rapidly forces molten metal into the die cavity 29.

During the slow movement of the plunger, the valve member 28 is opened to communicate the cavity 29 to the source of vacuum to evacuate the cavity and it is preferred that the valve member 28 close before the plunger is moved at its fast rate and before any molten casting material is actually injected into the die cavity itself. As is disclosed in the aforementioned application Ser. No. 874,755, the valve member 28 is extremely fast acting in its closing and preferably moves from its fully opened position to a closed position in approximately 10 to 15 milliseconds. This insures that the valve will be closed before molten metal could possibly reach the valve and thereby prevents it from being fouled or contaminated, which would require that the valve 12 be removed and cleared of any material so that the valve member 28 would effectively seal the internal chamber 32. The valve closing in approximately 10–15 milliseconds is fast enough to prevent fouling of the valve inasmuch as it requires approximately 30–35 milliseconds to complete the fast injection of the casting material into the die cavity.

Turning now to the process embodying the present invention, the process comprises a series of steps which begins with that of determining the amount of leakage that is present in the die cavity and aborting the casting operation if the amount of leakage exceeds a predetermined value. The process then clears the valve seat 26 of the first valve 12 with a rush of air and thereafter cools the same while keeping it clear of debris. The process then pressurizes the line 38 between the first valve 12 and the second valve 14 and determines if any leakage is present in that line and if leakage is determined, the casting operation is then aborted if the amount of leakage exceeds a predetermined value. The process then supplies a vacuum to the chamber 32 with the valve member 28 seated on seat 26, i.e., the first valve 12 is closed and it measures the vacuum level in the chamber 32 and aborts the casting operation if the level is not at a predetermined minimum level, preferably at approximately 28 to 29 inches of mercury. The process then starts the plunger means 48 and applies vacuum to the die cavity by the processor 10 generating signals to the plunger controller 20 to start the plunger apparatus in operation which involves moving the plunger at the slower rate while opening the valves 12 and 14 to communicate the vacuum from the vacuum pump to the die cavity itself. The vacuum level is then measured before the casting material reaches the die cavity 29 and if the vacuum level is not at a second predetermined minimum level, i.e., approximately 24 to 27 inches of mercury, the processor 10 commands the plunger controller 20 to abort the casting operation. If the level of vacuum in the cavity is at or above its predetermined minimum level, then the plunger controller 20 is commanded to perform the fast mode of plunger movement to inject the casting material into the die cavity.

Figure 2:
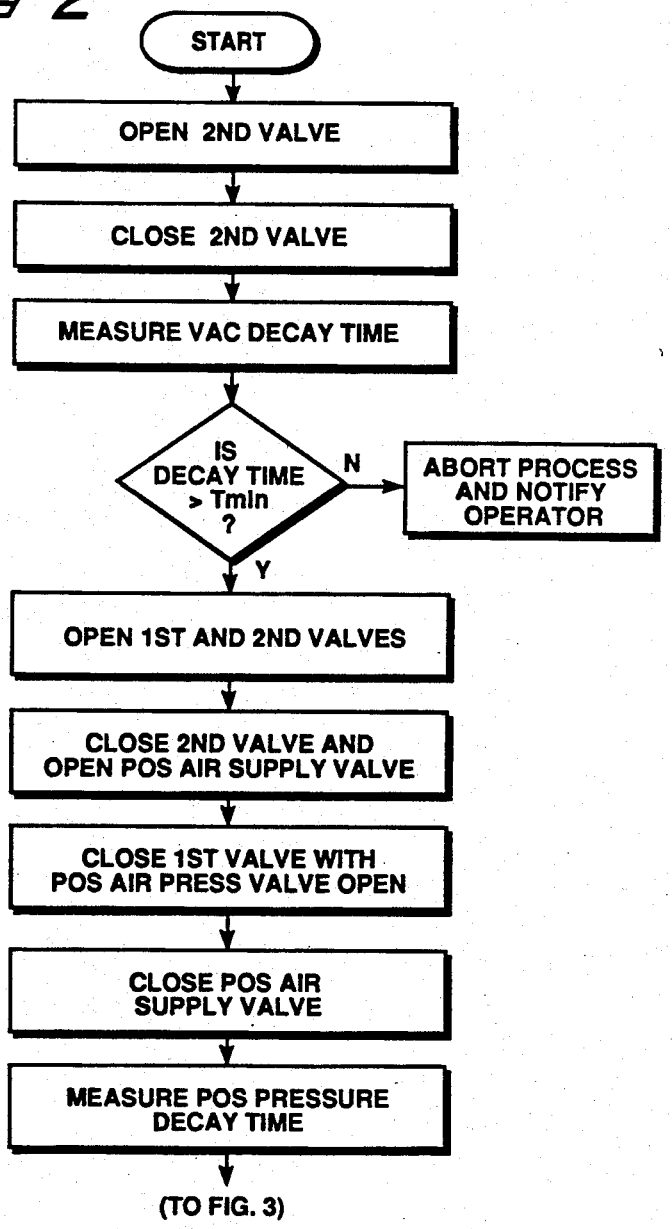
Figure 3:
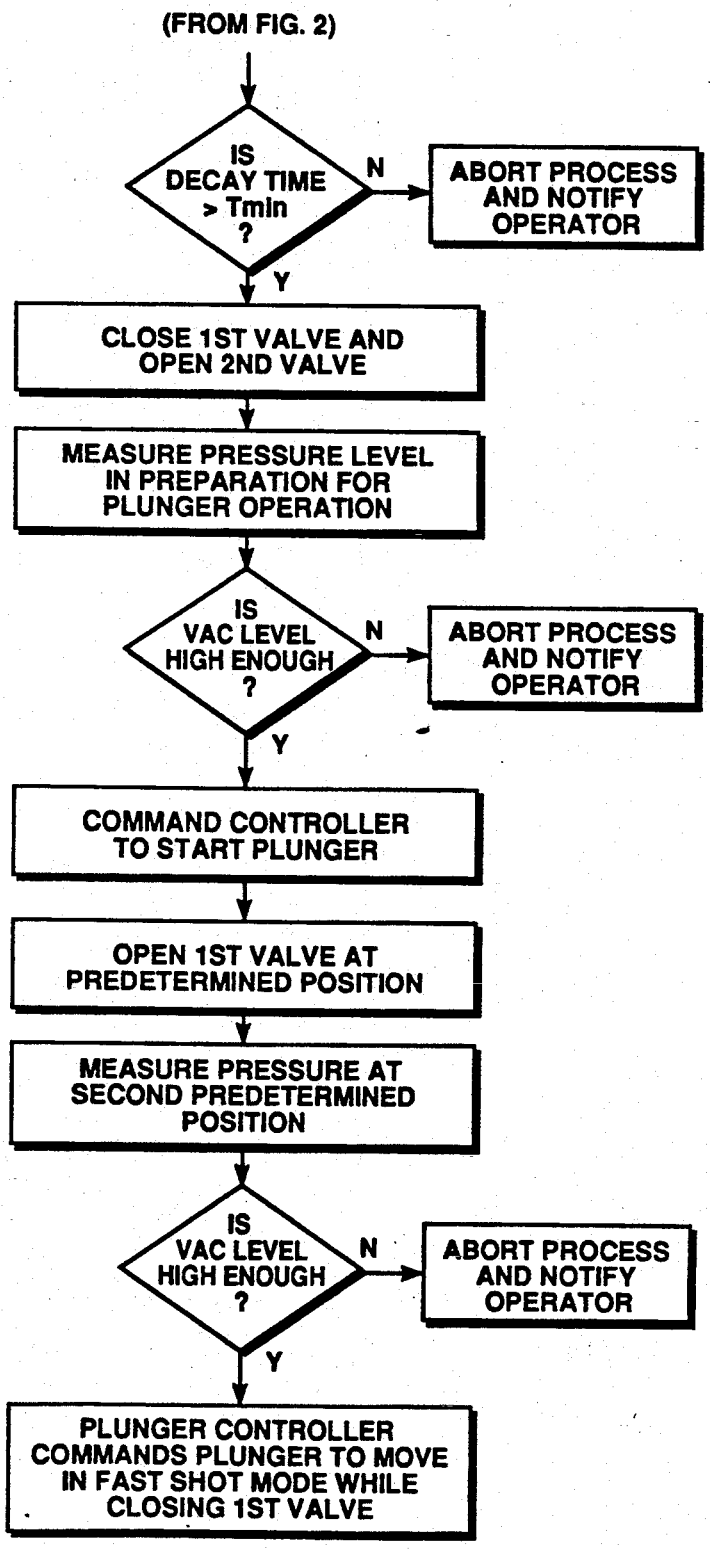

The above description generally describes the process, but the actual steps that are carried out to accomplish the process are also shown in the flow charts of FIGS. 2 and 3 which are specific instructions that are programmed in the memory means that is a part of the processor 10. In this regard, the processor 10 also includes the plunger controller 20 and is preferably a model SLC05/02 controller manufactured by the Allen Bradley Company of Milwaukee, Wis. Referring to FIG. 2, when a casting operation is started, the second valve 14 is opened and line 38 is evacuated. The second valve 14 is then closed and the vacuum/pressure transducer 18 measures the vacuum decay time together with the processor 10. It should be mentioned that the vacuum/pressure transducer is of conventional design, but is of the type which can measure pressures above and below atmospheric pressure.

Since line 38 is in communication with line 36, the transducer or sensor 18 effectively measures the vacuum level in the chamber 32, the port 36 and line 38 via the tube 42. It should be understood that the opening and closing of the second valve 14 to perform this vacuum decay measurement is done with the valve 12 closed, i.e., the valve member 28 is seated on seat 26. The vacuum decay time is determined by the pressure transducer providing the signal indicating the pressure level at a start time, and it is then compared with a later measurement taken approximately 1 second after the first and if the difference between the two values is more than approximately ½ to 1 inches of mercury, then it is assumed that the first valve 12 is contaminated and the process is aborted and the operator notified of a process fault.

The next step is to open both the first valve 12 and the second valve 14 which results in a rush of air from the evacuation of the die cavity being created which will clear the valve seat 26 of debris. This is done before the plunger controller is activated by the processor 10.

With the valve 12 opened, the second valve 14 is then closed and the positive air supply valve 16 is opened which results in compressed air from the positive air supply 46, which preferably is at a level of approximately 30 p.s.i., being blown through line 44, valve 16 and the tube 42 into the chamber 32 for approximately 1 to 2 seconds. This has the effect of blowing compressed air by the seat 26 and the valve member 28 for keeping these components clear of debris and also cooling the valve member 28. The 30 p.s.i. level of the positive air pressure is chosen to accommodate the transducer 18 which is operable over a range of 75 p.s.i. and to keep the air from forcing open the valve 12, which has the valve member held closed by a spring, as is comprehensively set forth in the aforementioned application entitled DOUBLE SOLENOID VALVE ACTUATOR, Ser. No. 874,755.

After the last described step is completed, the valve 12 is then closed and by virtue of the second valve 14 still being closed, the line 38 is pressurized at the approximately 30 p.s.i. level. The pressure decay time is then measured in a similar fashion as the prior vacuum decay time. If the difference between successive measurements of the pressure is greater than approximately 1 inch of mercury over a time period of approximately 1 second, the processor 10 aborts the operation and notifies the operator.

In preparation for the injection of casting material into the cavity, the pressure level in the valve chamber 32 is measured with the first valve 12 closed and the second valve 14 opened. If the desired vacuum level is not attained, which is preferably approximately 28 to 29 inches of mercury, the process is aborted and the operator is notified of a fault.

If the vacuum level is at or above the predetermined level, then the plunger controller 20 is commanded to start its operation and when it has effectively sealed the shot chamber thereof, i.e., air cannot pass through the shot sleeve, the runner communicating the shot sleeve with the die cavity, the first valve 12 is opened. The sealing of the shot chamber is accomplished when the plunger reaches a predetermined position during its stroke. The opening of the first valve 12 has the effect of evacuating the cavity itself. While the plunger is moving in its slower speed mode of operation which injects the casting material into the runner leading to the cavity, the vacuum level is measured and if it is not sufficiently high, i.e., approximately 24 to 27 inches of mercury, the process is aborted and the operator notified of a process fault.

It should be understood that the die cavity is formed by die components which must be separated from one another to remove the resulting casting that is made. The interface between components defines parting lines which permit some degree of leakage by their inherent nature. The leakage that inevitable occurs results in the vacuum level declining over time, but levels within the range of approximately 24 to 27 inches of mercury are generally considered sufficient to result in superior quality castings being formed. If the vacuum level does reach or exceed the second predetermined level, then the plunger controller 20 operates in the fast mode of operation to inject the casting material into the die cavity.

Generally simultaneously with the plunger controller moving the plunger in its fast shot mode, the first valve is also closed, which because of its fast acting capabilities, will reliably result in the valve member 28 seating with the seat 26 which will prevent any casting material from fouling the valve. Once the casting material has been injected into the cavity, the plunger controller 20 issues commands for returning the plunger to its retracted position in preparation for a subsequent casting operation.

From the foregoing, it should be appreciated and understood that an improved die casting process has been described which offers many significant advantages and desirable features over prior art processes. The capability of accurately monitoring a die casting operation results in reliability and prevents malfunctions that commonly occur in such process. At various important steps in a die casting operation, pressure levels are monitored and the process has the capability of aborting a casting operation at multiple times during the operation.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. A process for controlling the operation of a die casting apparatus during a casting operation to manufacture a casting, the apparatus being of the type which has a plunger means for injecting a shot of fluid casting material into a die cavity during the manufacture of each casting, the plunger means being of the type which can be moved from a retracted position to an extended position, and at variable speeds during such movement, a source of positive pressure and a source of vacuum pressure, a first valve means having a valve seat, a valve chamber adjacent the cavity and a valve member adapted to engage the seat when the valve means is closed and thereby isolate the valve chamber from the die cavity, the first valve means being adapted to communicate the die cavity with the source of vacuum pressure and the source of positive pressure, a selectively openable and closeable second valve means for communicating the vacuum through a line to the first valve means, a selectively openable and closeable positive pressure valve means for communicating said source of positive pressure with the first valve means, a means for measuring the pressure within the first valve means valve chamber and providing electrical signals indicative of the measured pressure, a controller for controlling the movement of the plunger means and a processing means adapted to receive said signals and to control the operation of each of the valve means and the plunger means controller, said process comprising the steps of:

determining any amount of leakage of the die cavity, and aborting the casting operation if the amount of leakage exceeds a predetermined value;

clearing the first valve means valve seat with a rush of air;

cooling the first valve means while keeping it clear of debris;

pressurizing the line between the first valve means and the second valve means and determining any amount of leakage of the line and the first and second valve means and aborting the casting operation if the amount of leakage exceeds a predetermined value;

applying a vacuum to the first valve means valve chamber with the first valve means being closed, measuring the vacuum level and aborting the casting operation if the level is not at a first predetermined minimum level;

starting the plunger means and applying vacuum to the die cavity;

measuring the vacuum level with the first and second valve means open before the fluid casting material enters the die cavity and aborting the casting operation if the level is not at a second predetermined minimum level; and, completing the movement of the plunger means to inject the fluid casting material into the die cavity.

2. A process as defined in claim 1 wherein said step of determining any amount of leakage of the die cavity comprises opening the second valve means and measuring any drop in the measured pressure level over a first predetermined time period.

3. A process as defined in claim 2 wherein the pressure level is measured over said first predetermined time period of approximately 1 second.

4. A process as defined in claim 3 wherein said casting operation is aborted when said predetermined value of pressure drop exceeds approximately 1 inch of mercury.

5. A process as defined in claim 1 wherein said step of clearing the first valve means valve seat with a rush of air comprises opening the first valve means and the second valve means.

6. A process as defined in claim 1 wherein said step of cooling the first valve means while keeping it clear of debris comprises opening the first valve means and the positive pressure valve means.

7. A process as defined in claim 1 wherein said step of pressurizing the line between the first valve means and the second valve means and determining any amount of leakage of the line and said first and second valve means and aborting the casting operation if the amount of leakage exceeds a predetermined value comprises closing the first valve means, the second valve means and the positive pressure valve means to pressurize the line, and then closing the positive pressure valve means and measuring any drop in the measured pressure level over a second predetermined time period.

8. A process as defined in claim 7 wherein the pressure level is measured over said second predetermined time period of approximately 1 second.

9. A process as defined in claim 8 wherein said casting operation is aborted when said predetermined value of pressure drop in the line exceeds approximately 1 inch of mercury.

10. A process as defined in claim 1 wherein said first predetermined minimum level is within the range of approximately 28 and 29 inches of mercury.

11. A process as defined in claim 1 wherein said second predetermined minimum level is within the range of approximately 24 and 27 inches of mercury.

12. A process as defined in claim 1 wherein said processing means generates signals to said controller to move the plunger means at a first predetermined speed until the plunger means moves a predetermined distance and thereafter at a second predetermined speed through the remainder of the movement thereof.

13. A process as defined in claim 12 wherein said first predetermined speed is within the range of approximately 10 to approximately 40 inches per second.

14. A process as defined in claim 12 wherein said second predetermined speed is within the range of approximately 75 to 80 inches per second.

15. A process for controlling the operation of a die casting apparatus during a casting operation for manufacturing a casting, the apparatus being of the type which has a plunger means for injecting a shot of fluid casting material into a die cavity in which the casting is formed, the plunger means being of the type which can be moved from a retracted position to an extended position at variable speeds during such movement, a source of positive pressure and a source of vacuum pressure, a selectively openable and closeable first valve means having a valve seat, a valve chamber near the cavity and a valve member adapted to engage the seat when the valve means is closed and thereby isolate the valve chamber from the die cavity, the first valve means being adapted to communicate the die cavity with the source of vacuum pressure and the source of positive pressure, a selectively openable and closeable second valve means for communicating the vacuum through a line to the first valve means, a selectively openable and closeable positive pressure valve means for communicating the source of positive pressure with the first valve means, a means for measuring the pressure within the first valve means valve chamber and providing electrical signals indicative of the measured pressure, a controller for controlling the operation and movement of the plunger means and a processing means adapted to receive the pressure indicative signals and control the operation of the first valve means, the second valve means, the positive pressure valve means and the controller of the plunger means, said process comprising the steps of:

determining any amount of leakage of the die cavity, and aborting the casting operation if the amount of leakage exceeds a predetermined value;

clearing the first valve means valve seat with a rush of air, if the casting operation is not aborted;

applying a vacuum to the first valve means valve chamber with the first valve means being closed, measuring the vacuum level and aborting the casting operation if the level is not at a first predetermined minimum level;

if the casting operation is not aborted, applying a vacuum to the die cavity and starting the plunger means;

measuring the vacuum level with the first valve means open before the fluid casting material enters the die cavity and aborting the casting operation if the level is not at a second predetermined minimum level; and, completing the movement of the plunger means to inject the fluid casting material into the die cavity.

16. A process as defined in claim 15 further including the step of cooling the first valve means while keeping it clear of debris after the initial step of determining any amount of leakage of the die cavity is completed.

17. A process as defined in claim 16 further including the step of pressurizing the line between the first valve means and the second valve means and determining any amount of leakage of the line and the first valve means after said cooling step is performed, and aborting the casting operation if the amount of leakage exceeds a predetermined value.

18. A process as defined in claim 15 wherein said step of determining any amount of leakage of the die cavity comprises opening the first and second valve means and measuring any drop in the measured pressure level over a first predetermined time period.

19. A process as defined in claim 18 wherein the pressure level is measured over said first predetermined time period of 1 second.

20. A process as defined in claim 19 wherein said casting operation is aborted when said predetermined value of pressure drop exceeds approximately 1 inch of mercury.

21. A process as defined in claim 16 wherein said step of clearing the first valve means valve seat with a rush of air comprises opening the first valve means and the second valve means.

22. A process as defined in claim 17 wherein said step of cooling the first valve means while keeping it clear of debris comprises opening the first valve means and the positive pressure valve means.

23. A process as defined in claim 15 wherein said step of pressurizing the line between the first valve means and the second valve means and determining any amount of leakage of the line and aborting the casting operation if the amount of leakage exceeds a predetermined value comprises closing the first valve means, the second valve means and the positive pressure valve means to pressurize the line, and then closing the positive pressure valve means and measuring any drop in the measured pressure level over a second predetermined time period.

24. A process as defined in claim 23 wherein the pressure level is measured over said second predetermined time period of approximately 1 second.

25. A process as defined in claim 24 wherein said casting operation is aborted when said predetermined value of pressure drop in the line exceeds approximately 1 inch of mercury.

26. A process as defined in claim 15 wherein said first predetermined minimum level is within the range of approximately 28 and 29 inches of mercury.

27. A process as defined in claim 15 wherein said second predetermined minimum level is within the range of approximately 24 and 27 inches of mercury.

28. A process as defined in claim 15 wherein said processing means generates signals to said controller to move the plunger means at a first predetermined speed until the plunger means moves a predetermined distance and thereafter at a second predetermined speed through the remainder of the movement thereof.

29. A process as defined in claim 15 wherein said first predetermined speed is approximately 15 inches per second.

30. A process as defined in claim 15 wherein said second predetermined speed is within the range of approximately 75 to 80 inches per second.

* * * * *